US011296449B2

(12) United States Patent
Menzies et al.

(10) Patent No.: US 11,296,449 B2
(45) Date of Patent: Apr. 5, 2022

(54) ELECTRICAL CONNECTOR ASSEMBLY HAVING IDENTICAL ELECTRICAL CONNECTORS

(71) Applicant: Lear Corporation, Southfield, MI (US)

(72) Inventors: David Menzies, Linden, MI (US); Anthony Butcher, Troy, MI (US); Bhupinder Rangi, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/863,170

(22) Filed: Apr. 30, 2020

(65) Prior Publication Data

US 2021/0344133 A1 Nov. 4, 2021

(51) Int. Cl.

| | |
|---|---|
| ***H01R 13/28*** | (2006.01) |
| ***H01R 13/645*** | (2006.01) |
| ***H01R 13/627*** | (2006.01) |
| ***H01R 24/84*** | (2011.01) |

(52) U.S. Cl.

CPC ..... *H01R 13/28* (2013.01); *H01R 13/6271* (2013.01); *H01R 13/6456* (2013.01); *H01R 24/84* (2013.01)

(58) Field of Classification Search

CPC ..... H01R 13/28; H01R 24/84

See application file for complete search history.

(56) References Cited

U.S. PATENT DOCUMENTS

| | | | | |
|---|---|---|---|---|
| 2,335,843 | A | 11/1943 | Rogoff | |
| 2,434,226 | A | 1/1948 | Reynolds | |
| 3,794,957 | A * | 2/1974 | Winkler | H01R 13/28 439/295 |
| 5,108,304 | A | 4/1992 | Bogiel et al. | |
| 5,308,258 | A * | 5/1994 | Hatsios | H01R 13/28 439/284 |
| 6,065,987 | A | 5/2000 | Bigotto | |
| 6,089,898 | A * | 7/2000 | Lincoln, III | H01R 13/6272 439/357 |

* cited by examiner

*Primary Examiner* — Ross N Gushi

(74) *Attorney, Agent, or Firm* — MacMillan, Sobanski & Todd, LLC

(57) ABSTRACT

An electrical connector assembly includes first and second electrical connectors that are identical in structure. The first electrical connector includes a first housing component having a terminal recess provided therein, a second housing component having a terminal recess provided therein, and a wire terminal assembly including an electrical terminal that is supported by the terminal recesses provided in the first and second housing components of the first electrical connector. The second electrical connector also includes a first housing component having a terminal recess provided therein, a second housing component having a terminal recess provided therein, and a wire terminal assembly including an electrical terminal that is supported by the terminal recesses provided in the first and second housing components of the second electrical connector. The electrical terminal of the first electrical connector and the electrical terminal of the second electrical connector engage one another.

12 Claims, 9 Drawing Sheets

ELECTRICAL CONNECTOR ASSEMBLY HAVING IDENTICAL ELECTRICAL CONNECTORS

BACKGROUND OF THE INVENTION

This invention relates in general to electrical connector assemblies for selectively providing mechanical and electrical connections between first and second electrical conductors. In particular, this invention relates to an improved structure for such an electrical connector assembly having first and second electrical connectors that are identical in shape.

In a conventional electrical distribution system, a source of electrical energy (such as a generator or a battery) supplies electrical energy through one or more electrical conductors (such as wires or bus bars) to respective electrically operated devices. To facilitate the assembly and maintenance of the electrical distribution system, it is often desirable that some or all of those electrically operated devices be releasably connected to the source of electrical energy. This can be accomplished by providing an electrical connector assembly between respective electrical conductors extending from the electrically operated devices and the source of electrical energy. These electrical connector assemblies are designed to selectively connect and disconnect the respective electrical conductors (and, therefore, the associated electrically operated devices and the source of electrical energy) to and from one another, both mechanically and electrically.

A typical electrical connector assembly includes a first electrical connector that is connected to a first one of the electrical conductors and a second electrical connector that is connected to a second one of the electrical conductors. The first and second electrical connectors are designed to selectively mate with one another to provide the mechanical and electrical connections therebetween. To accomplish this, each of the electrical connectors usually includes an outer electrically non-conductive housing that supports an electrically conductive terminal therein. Each of the terminals is connected to the associated electrical conductor and is protectively enclosed within the housing to prevent unintended contact during installation and use. Each of the housings usually includes one or more retainers that are adapted to cooperate with corresponding retainers provided on the housing of the mating electrical connector. When the first and second electrical connectors are mated with one another to form the electrical connector assembly, the respective retainers engage one another to mechanically retain the housings of the electrical connectors together and electrically engage the terminals of the electrical connectors with one another.

A wide variety of electrical connector assemblies are known in the art and have functioned satisfactorily. In most instances, the first and second electrical connectors have different structures, such as well known male and female electrical connectors for example. Although such different electrical connector structures are effective, they undesirably increase the cost and complexity of the electrical connector assembly. Thus, it would be desirable to provide an improved structure for an electrical connector assembly having first and second electrical connectors that are identical in shape.

SUMMARY OF THE INVENTION

This invention relates to an improved structure for an electrical connector assembly having first and second electrical connectors that are identical in shape. The first electrical connector includes a first housing component having a terminal recess provided therein, a second housing component having a terminal recess provided therein, and a wire terminal assembly including an electrical terminal that is supported by the terminal recesses provided in the first and second housing components of the first electrical connector. The second electrical connector includes a first housing component having a terminal recess provided therein, a second housing component having a terminal recess provided therein, and a wire terminal assembly including an electrical terminal that is supported by the terminal recesses provided in the first and second housing components of the second electrical connector. The electrical terminal of the first electrical connector and the electrical terminal of the second electrical connector engage one another.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
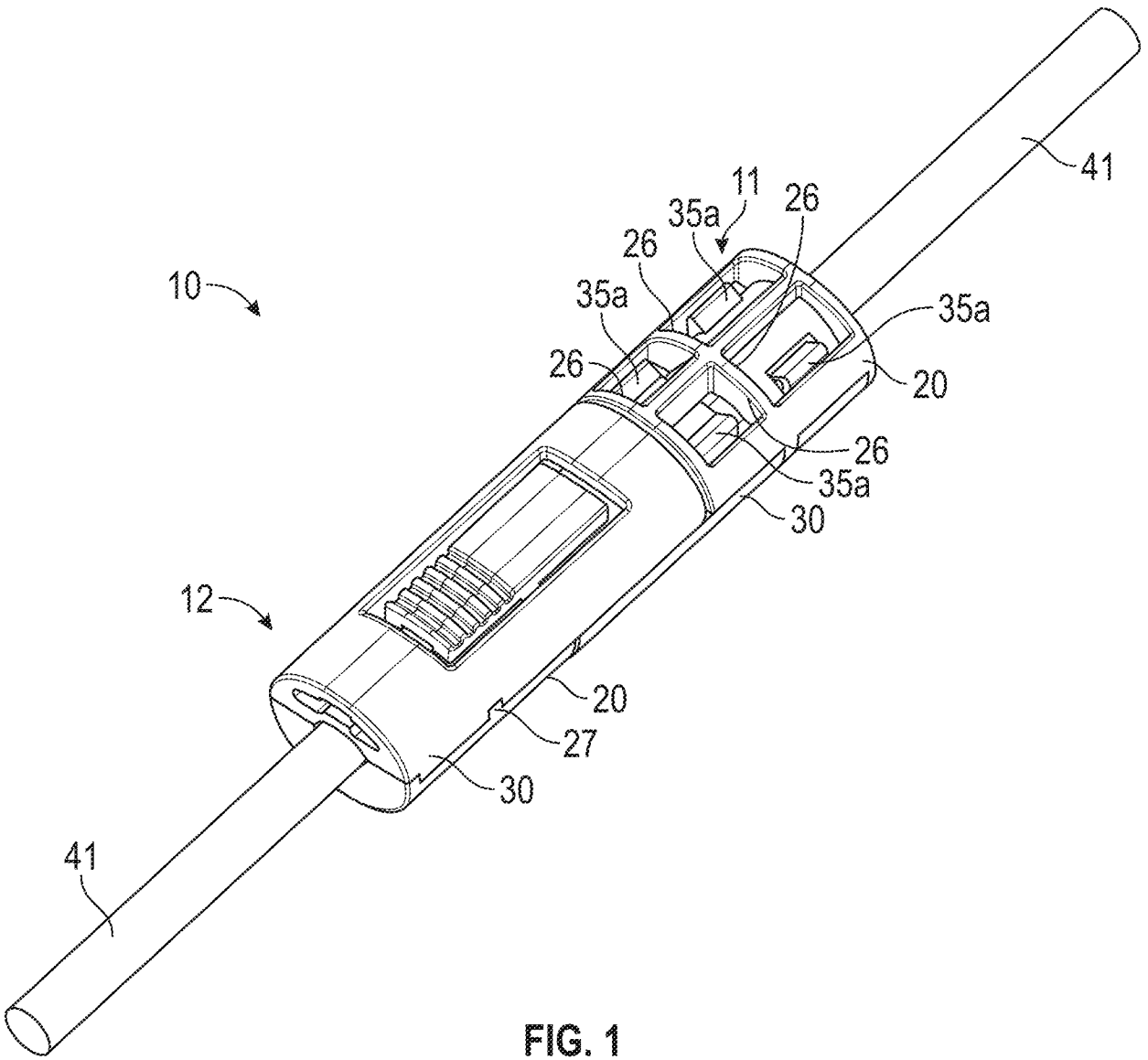
FIG. 1 is a perspective view of an electrical connector assembly in accordance with this invention.
Figure 2:
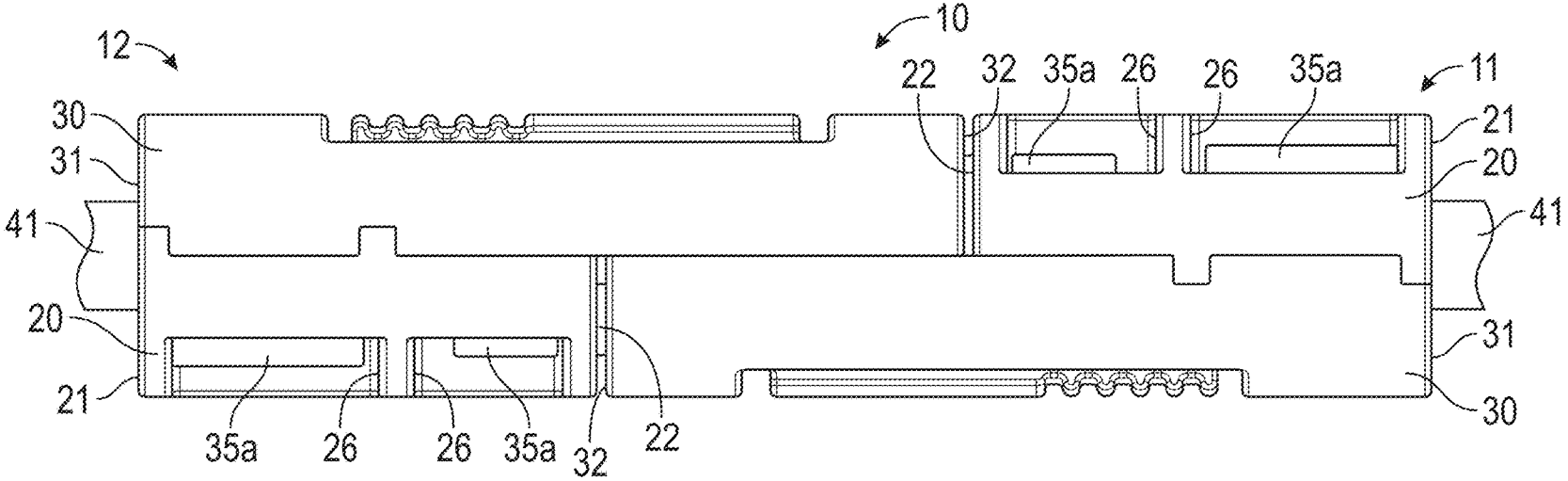
FIG. 2 is a side elevational view of the electrical connector assembly illustrated in FIG. 1.

Referring now to the drawings, there is illustrated in FIGS. 1 through 8 an electrical connector assembly, indicated generally at 10, in accordance with this invention. The electrical connector assembly 10 includes a first electrical connector, indicated generally at 11, and a second electrical connector, indicated generally at 12. As will be explained in detail below, the first electrical connector 11 and the second electrical connector 12 are identical in shape and structure. Thus, only the components of the first electrical connector 11 will be discussed in detail, and like reference numbers will be used to indicate the corresponding identical components of the second electrical connector 12.

The first electrical connector 11 includes a first housing component 20 that is generally hollow and semi-cylindrical in shape, extending axially from a first end 21 to a second end 22. However, the first housing component 20 may have any desired shape. The first housing component 20 is preferably formed from an electrically non-conductive material, such as plastic. However, the first housing component 20 may be formed from any desired material or combination of materials. A cantilevered arm 23 extends axially from the second end 22 of the first housing component 20, for a purpose that will be explained below. A wire recess 24 extends axially from the first end 21 of the first housing component 20 toward the interior thereof. The illustrated wire recess 24 is generally semi-cylindrical in shape and includes a plurality (three in the illustrated embodiment) of semi-annular ribs 24*a*, although such is not required. One or more terminal recesses 25 extend axially from the wire recess 24 to the second end 22 of the first housing component 20. In the illustrated embodiment, two of such terminal recesses 25 extend parallel to one another, although such is not required. A polarizer recess 25*a* is provided within each of the terminal recesses 25. The purpose for the polarizer recesses 25*a* will be explained below.

The first housing component 20 of the first electrical connector 11 also has one or more locking openings 26. In the illustrated embodiment, six of such locking openings 26 extend completely through the first housing component 20 (two of which extend through the cantilevered arm 23). However, a greater or lesser number of such locking openings 26 may be provided, and some or all of such locking openings 26 may not extend completely through the first housing component 20. Additionally, the first housing component 20 of the first electrical connector 11 has one or more alignment protrusions 27 provided thereon. In the illustrated embodiment, two of such alignment protrusions 27 are provided on opposite sides of the first housing component 20. However, a greater or lesser number of such alignment protrusions 27 may be provided at any desired locations of the first housing component 20. Also, a retainer opening 28 is provided in the first housing component 20 for a purpose that will be described below.

The first electrical connector 11 also includes a second housing component 30 that is generally hollow and semi-cylindrical in shape, extending axially from a first end 31 to a second end 32. However, the second housing component 30 may have any desired shape. The second housing component 30 is also preferably formed from an electrically non-conductive material, such as plastic. However, the second housing component 30 may be formed from any desired material or combination of materials. A wire recess 33 extends axially from the first end 31 of the second housing component 30 toward the interior thereof. The illustrated wire recess 33 is generally semi-cylindrical in shape, although such is not required. One or more terminal recesses 34 extend axially from the wire recess 33 to the second end 32 of the second housing component 30.

Figure 8:
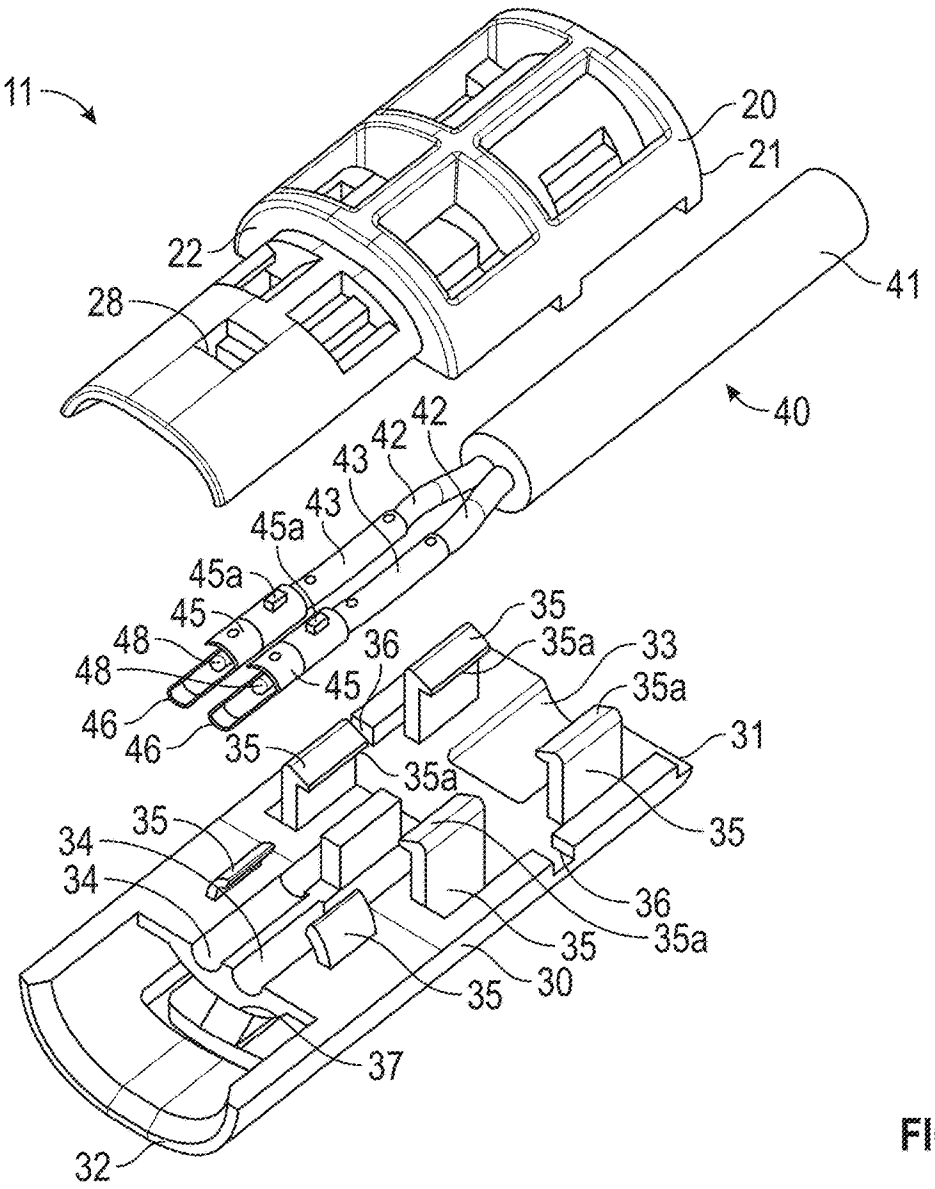
FIG. 8 is an exploded perspective view from below of the one of the electrical connectors of the electrical connector assembly illustrated in FIG. 7.

The second housing component 30 of the first electrical connector 11 also has one or more locking arms 35. In the illustrated embodiment, six of such locking arms 35 extend completely inwardly from the second housing component 30. However, a greater or lesser number of such locking arms 35 may be provided. As best shown in FIG. 8, each of the locking arms 35 terminates in an inwardly-extending lip 35*a*, although such is not required. Additionally, the second housing component 30 of the first electrical connector 11 has one or more alignment openings 36 provided thereon. In the illustrated embodiment, two of such alignment openings 36 are provided on opposite sides of the second housing component 30. However, a greater or lesser number of such alignment openings 36 may be provided at any desired locations of the second housing component 30. Also, a retainer 37 is provided on the second housing component 30 for a purpose that will be explained below.

Lastly, the first electrical connector 11 includes a wire terminal assembly, indicated generally at 40. The illustrated wire terminal assembly 40 includes an outer insulator 41 containing one or more electrical conductors 42. In the illustrated embodiment, two of such electrical conductors 42 are contained within the outer insulator 41, although a greater or lesser number may be provided. Each of the electrical conductors 42 terminates in an electrical terminal, indicated generally at 43. The illustrated electrical terminals 43 are identical in shape, although such is not required.

Figure 10:
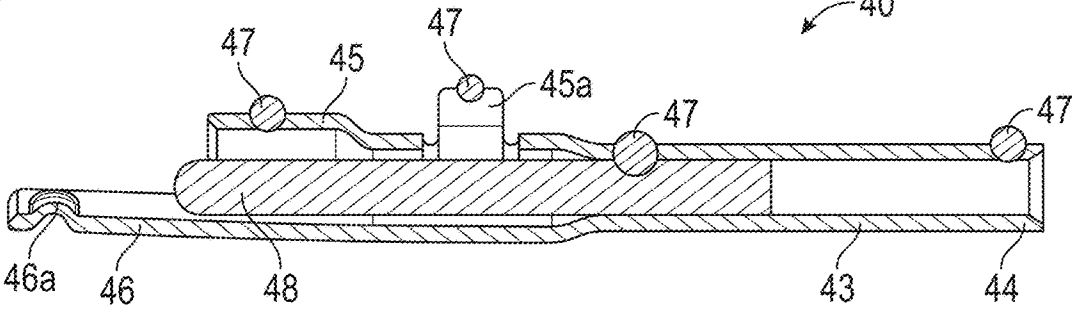
FIG. 10 is a sectional elevational view of the terminal illustrated in FIG. 9.
Figure 11:
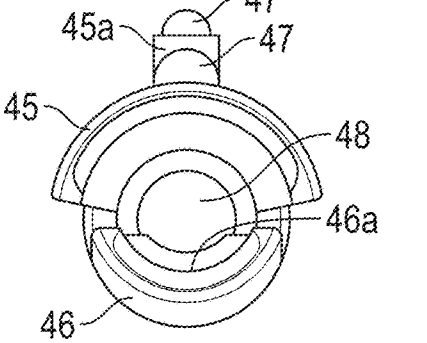
FIG. 11 is an end elevational view of the terminal illustrated in FIGS. 9 and 10.
Figure 9:
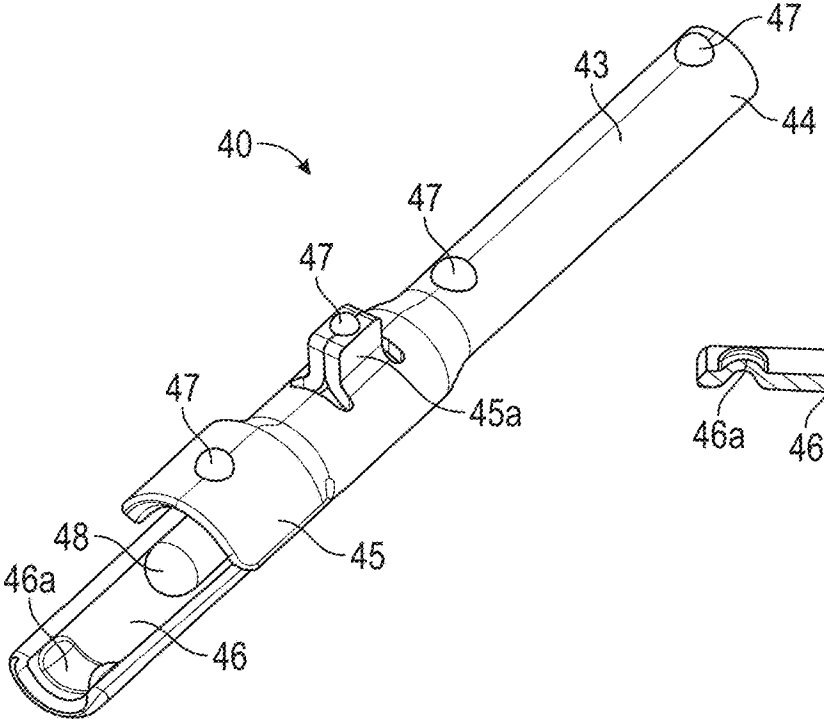
FIG. 9 is an enlarged perspective view of one of the terminals of the electrical connectors illustrated in FIGS. 1 through 8.
Figure 12:
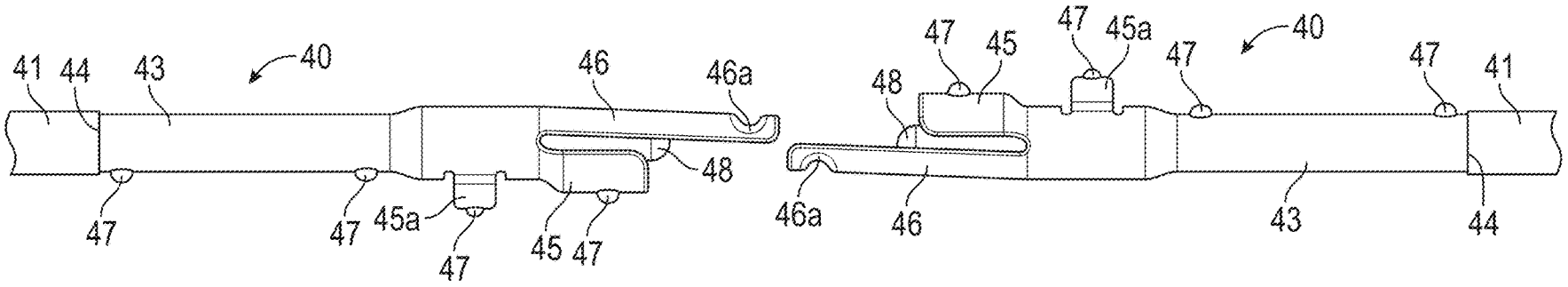
FIG. 12 is an exploded side elevational view of two of the terminals illustrated in FIGS. 9, 10, and 11 shown prior to assembly.
Figure 13:
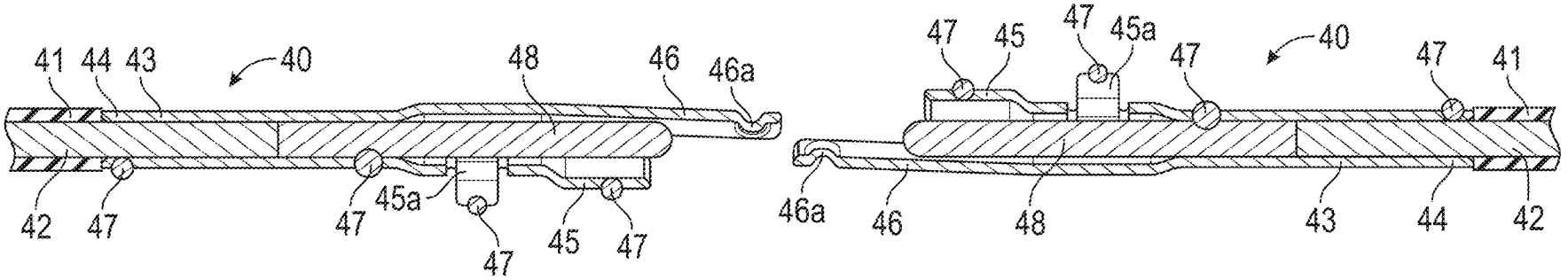
FIG. 13 is a sectional elevational view of the two terminals illustrated in FIG. 12.
Figure 14:
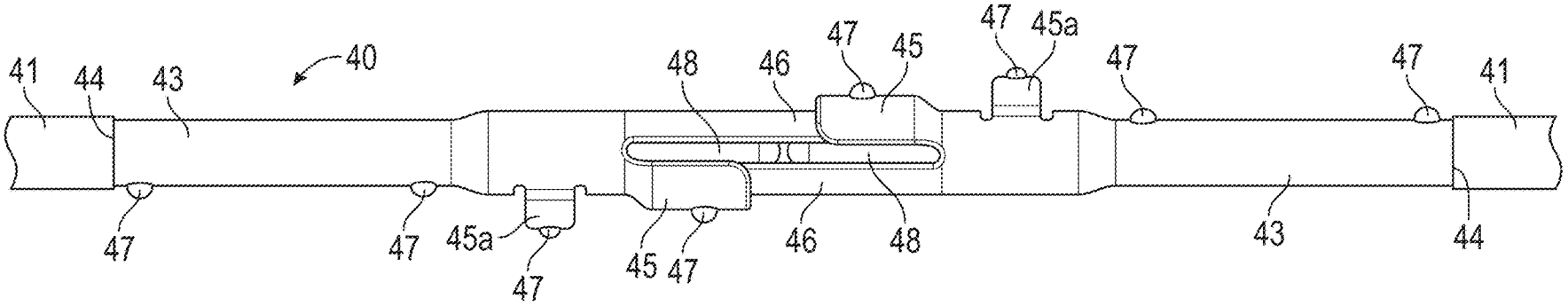
FIG. 14 is a side elevational view of the two terminals illustrated in FIGS. 12 and 13 shown assembled.

The structure of one of the electrical terminals 43 is illustrated in detail in FIGS. 9, 10, and 11. As shown therein, the electrical terminal 43 includes a wire receiving end 44 that is generally hollow and cylindrical in shape, although such is not required. A first terminal arm 45 extends axially from the wire receiving end 44 of the electrical terminal 43. The illustrated first terminal arm 45 is generally semi-cylindrical in shape, although such is not required. An optional polarizer 45*a* extends generally radially outwardly from the first terminal arm 45. A second terminal arm 46 also extends axially from the wire receiving end 44 of the electrical terminal 43. The illustrated second terminal arm 46 is generally semi-cylindrical in shape, although again such is not required. An optional deformed region 46*a* is provided at the end of the second terminal arm 46 for a purpose that will be explained below.

In the illustrated embodiment, the wire receiving end 44, the first terminal arm 45, the polarizer 45*a*, and the second terminal arm 46 are all formed from a single piece of material that is deformed into the illustrated hollow cylindrical orientation and retained therein by a plurality of welds 47. However, the wire receiving end 44, the first terminal arm 45, the polarizer 45*a*, and the second terminal arm 46 may be formed in any desired manner.

The electrical terminal further includes a terminal plug 48. In the illustrated embodiment, the terminal plug 48 is solid and cylindrical in shape. However, the terminal plug 48 may have any desired shape. As best shown in FIG. 10, the terminal plug 48 is disposed within the hollow interior of the electrical terminal 43 and is retained therein by one of the welds 47. Thus, the wire receiving end 44, the first terminal arm 45, the second terminal arm 46, and the terminal plug 48 of the electrical terminal 43 are all electrically connected to one another.

Figure 7:
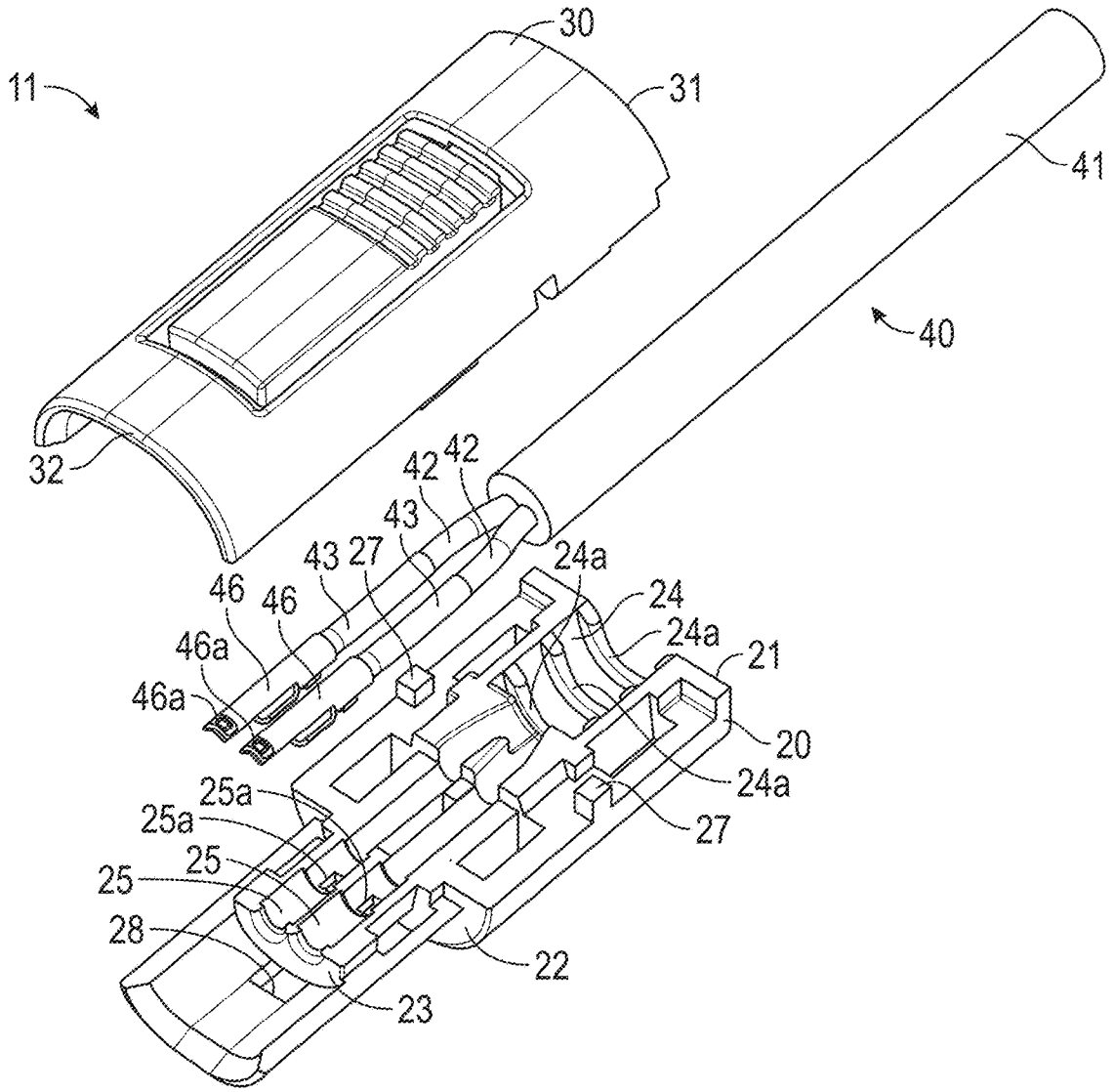
FIG. 7 is an exploded perspective view from above of one of the electrical connectors of the electrical connector assembly illustrated in FIGS. 1 through 6.

The manufacture of the electrical connector assembly 10 of this invention will now be described with reference to the drawings. Initially, as best shown in FIG. 7, the wire terminal assembly 40 is initially manufactured by electrically connecting one of the electrical terminals 43 to the end of each of the electrical conductors 42 provided within the outer insulator 41. This may be accomplished in any desired manner, such as by welding, crimping, and the like.

Next, the wire terminal assembly 40 is aligned with the first housing component 20 and the second housing component 30, as also shown in FIG. 7. The wire terminal assembly 40 is then moved into engagement with the first housing component 20 such that the outer insulator 41 is received within the wire recess 24 and the electrical terminals 43 are respectively received within the terminal recesses 25. When this occurs, the ribs 24*a* provided in the wire recess 24, as well as the other portions of the wire recess 24, engage the outer insulator 41 of the wire terminal assembly 40. At the same time, the polarizers 45*a* provided on the electrical terminals 43 are respectively received within the polarizer recesses 25*a* provided in the terminal recesses 25 of the first housing component 20. Thus, each of the electrical terminals 43 is positively positioned in a precise location relative to the first housing component 20.

Figure 5:
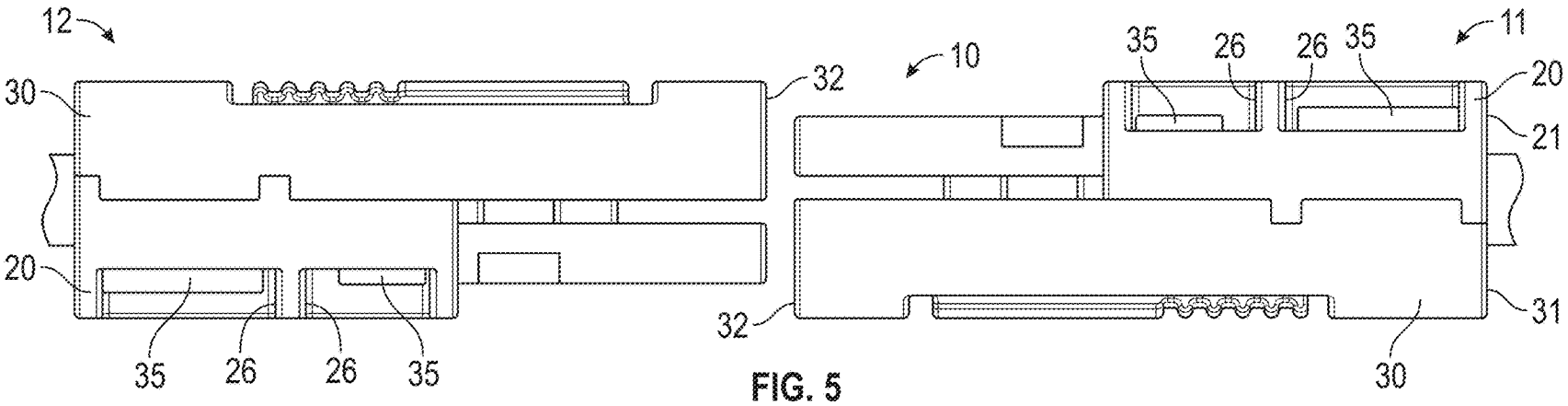
FIG. 5 is a side elevational view of the exploded electrical connector assembly illustrated in FIG. 4.
Figure 6:
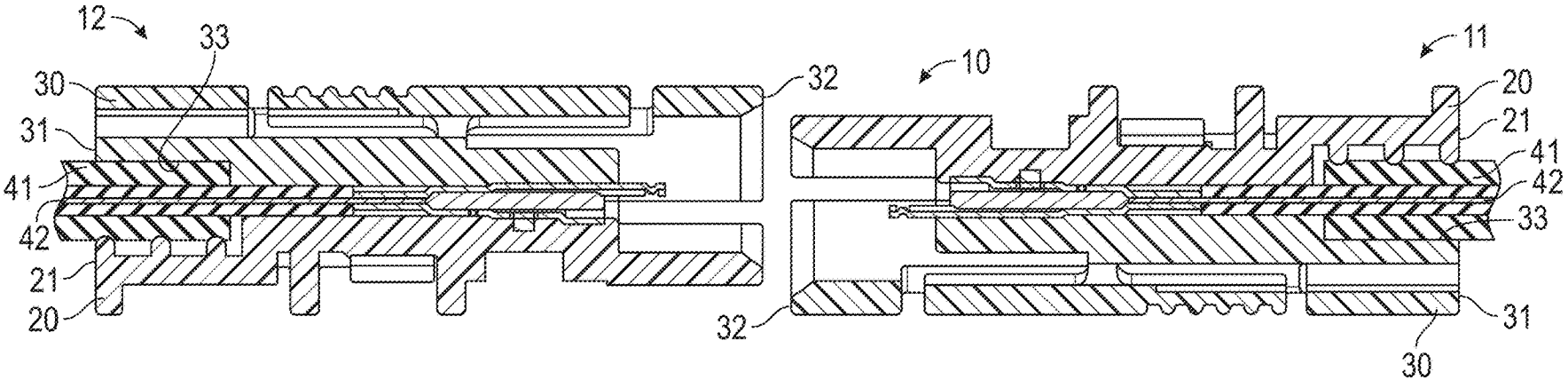
FIG. 6 is a sectional elevational view of the exploded electrical connector assembly illustrated in FIGS. 4 and 5.

Lastly, the second housing component 30 is moved into engagement with the first housing component 20 such that the locking arms 35 are received within the locking openings 26 and the alignment openings 36 receive the alignment protrusions 27. As best shown in FIGS. 1, 2, 4, 5, and 6, the lips 35*a* of the locking arms 35 engage respective portions of the first housing component 20 located about the peripheries of the locking openings 26. Thus, as best shown in FIGS. 5 and 6, the first housing component 20 and the second housing component 30 are retained together to form the assembled first electrical connector 11, within which the wire terminal assembly 40 is supported and retained. The second electrical connector 12 is manufactured in an identical manner.

To complete the manufacture of the electrical connector assembly 10 of this invention, the first electrical connector 11 and the second electrical connector 12 are initially co-axially aligned with each other as shown in FIGS. 4, 5, 6, 12, and 13. When so aligned, the first electrical connector 11 and the second electrical connector 12 are disposed at a 180° opposite orientation relative to one another. Then, the first electrical connector 11 and the second electrical connector 12 are moved axially toward one another to the final assembled position shown in FIGS. 1, 2, 3, 14, and 15.

Figure 15:
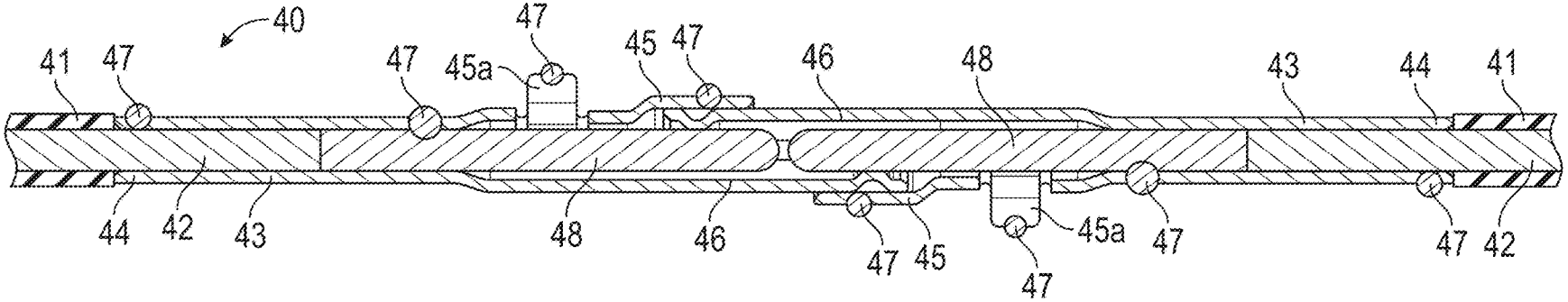
FIG. 15 is a sectional elevational view of the two terminals illustrated in FIG. 14.

As a result, an electrically-conductive connection is established between the wire terminal assembly 40 of the first electrical connector 11 and the wire terminal assembly 40 of the second electrical conductor 12. Specifically, as best shown in FIG. 15, the second terminal arm 46 of the first electrical connector 11 is received between the first terminal arm 45 and the terminal plug 48 of the second electrical connector 12. Similarly, the second terminal arm 46 of the second electrical connector 12 is received between the first terminal arm 45 and the terminal plug 48 of the first electrical connector 11. Preferably, the deformed regions 46*a* of the second terminal arms 46 are flexibly compressed between the first terminal arms 45 and the terminal plugs 48. This ensures that a reliable electrical connection is established and maintained between the first electrical connector 11 and the second electrical connector 12 and, thus, the respective electrical conductors 42.

Figure 3:
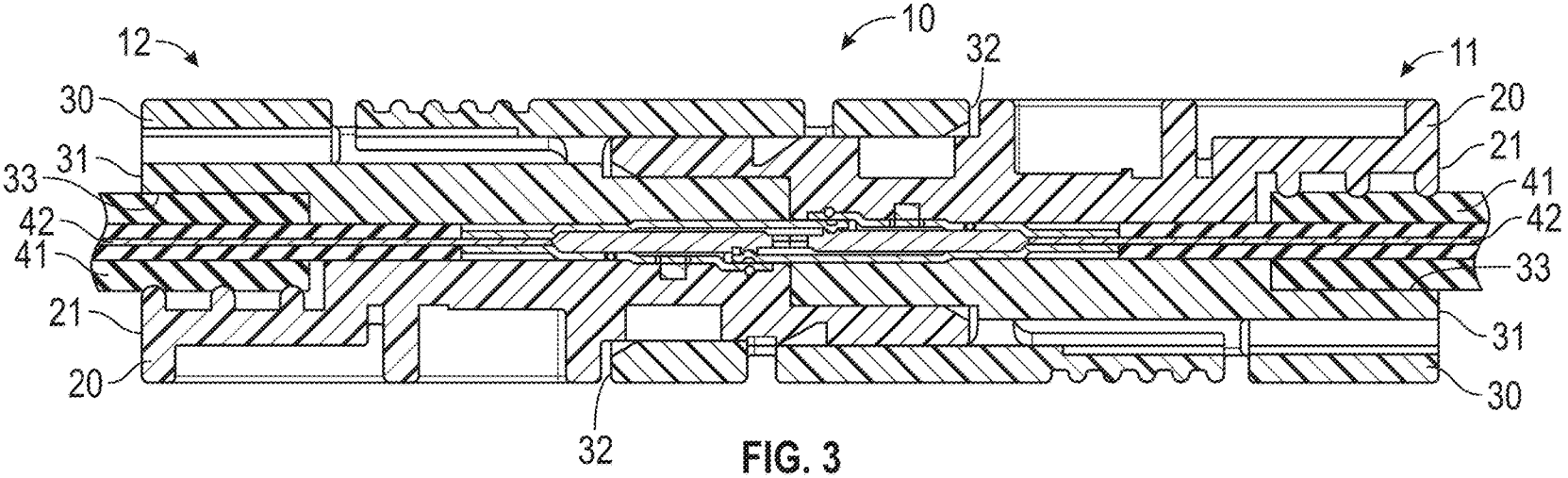
FIG. 3 is a sectional elevational view of the electrical connector assembly illustrated in FIGS. 1 and 2.
Figure 4:
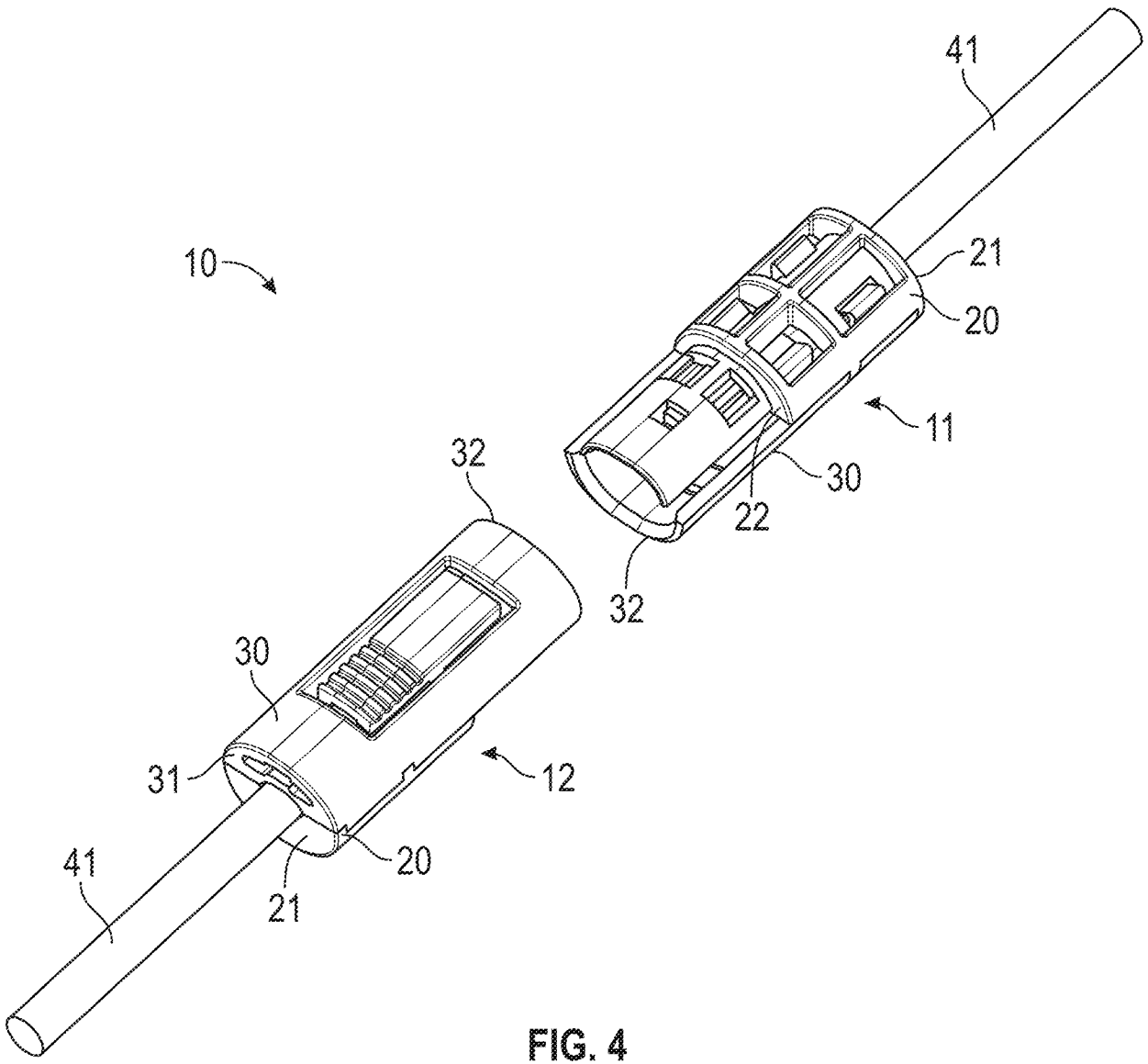
FIG. 4 is an exploded perspective view of the electrical connector assembly illustrated in FIGS. 1, 2, and 3, wherein first and second identical electrical connectors of the electrical connector assembly are shown prior to assembly.

Additionally, a mechanical connection is established between the first electrical connector 11 and the second electrical connector 12. This is accomplished by the retainers 37 provided on the second housing components 30, which are respectively received within the retainer openings 28 provided on the first housing components 20, as best shown in FIG. 3. As a result, a secure mechanical connection is provided between the first electrical connector 11 and the second electrical connector 12.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector assembly comprising:

a first electrical connector including a first housing component having a terminal recess provided therein, a second housing component having a terminal recess provided therein, and a wire terminal assembly including an electrical terminal that is supported by the terminal recesses provided in the first and second housing components of the first electrical connector, wherein portions of the first housing component and the second housing component engage one another to retain the first housing component and the second housing component of the first electrical connector together; and a second electrical connector including a first housing component having a terminal recess provided therein, a second housing component having a terminal recess provided therein, and a wire terminal assembly including an electrical terminal that is supported by the terminal recesses provided in the first and second housing components of the second electrical connector, wherein portions of the first housing component and the second housing component engage one another to retain the first housing component and the second housing component of the second electrical connector together; wherein the first electrical connector and the second electrical connector are identical in structure; and the electrical terminal of the first electrical connector and the electrical terminal of the second electrical connector engage one another, and further wherein:

(1) each of the first housing components has a polarizer recess, and each of the electrical terminals has a polarizer that cooperates with the polarizing recess; or (2) wherein each of the first housing components has a polarizer recess provided in the terminal recess, and each of the electrical terminals has a polarizer that cooperates with the polarizing recess; or (3) each of the first housing components has an alignment protrusion, and each of the electrical terminals has an alignment opening that cooperates with the alignment protrusion; or (4) wherein each of the first housing components has a cantilevered arm including both the terminal recess and a retainer opening, and each of the second housing components has a retainer that cooperates with the retainer opening of the first electrical connector to retain the first and second electrical connectors together; or (5) each of the first housing components has a cantilevered arm including the terminal recess and a polarizer recess provided in the terminal recess, and each of the electrical terminals has a polarizer that cooperates with the polarizing recess; or (6) the electrical terminal supported within the first electrical connector includes a first terminal arm and a second terminal arm; the electrical terminal supported within the second electrical connector includes a first terminal arm and a second terminal arm; the first terminal arm of the electrical terminal supported within the first electrical connector engages the second terminal arm of the electrical terminal supported within the second electrical connector; and the second terminal arm of the electrical terminal supported within the first electrical connector engages the first terminal arm of the electrical terminal supported within the second electrical connector; or (7) the electrical terminal supported within the first electrical connector includes a first terminal arm, a second terminal arm, and a terminal plug; the electrical terminal supported within the second electrical connector includes a first terminal arm, a second terminal arm, and a terminal plug; the first terminal arm of the electrical terminal supported within the first electrical connector engages both the second terminal arm and the terminal plug of the electrical terminal supported within the second electrical connector; and the second terminal arm of the electrical terminal supported within the first electrical connector engages both the first terminal arm and the terminal plug of the electrical terminal supported within the second electrical connector; or (8) the electrical terminal supported within the first electrical connector includes a first terminal arm and a second terminal arm; the electrical terminal supported within the second electrical connector includes a first terminal arm and a second terminal arm; the first terminal arm of the electrical terminal supported within the first electrical connector engages the second terminal arm of the electrical terminal supported within the second electrical connector; and the second terminal arm of the electrical terminal supported within the first electrical connector engages the first terminal arm of the electrical terminal supported within the second electrical connector; or (9) the electrical terminal supported within the first electrical connector includes a first terminal arm and a second terminal arm; the electrical terminal supported within the second electrical connector includes a first terminal arm and a second terminal arm; the first terminal arm of the electrical terminal supported within the first electrical connector engages the second terminal arm of the electrical terminal supported within the second electrical connector; and the second terminal arm of the electrical terminal supported within the first electrical connector engages the first terminal arm of the electrical terminal supported within the second electrical connector.

2. The electrical connector assembly defined in claim 1 wherein each of the first housing components has a locking opening, and wherein each of the second housing components has a locking arm that cooperates with the locking opening to connect each of the first and second housing components together.

3. The electrical connector assembly defined in claim 1 wherein each of the first housing components has a polarizer recess, and wherein each of the electrical terminals has a polarizer that cooperates with the polarizing recess.

4. The electrical connector assembly defined in claim 1 wherein each of the first housing components has a polarizer recess provided in the terminal recess, and wherein each of the electrical terminals has a polarizer that cooperates with the polarizing recess.

5. The electrical connector assembly defined in claim 1 wherein each of the first housing components has an alignment protrusion, and wherein each of the electrical terminals has an alignment opening that cooperates with the alignment protrusion.

6. The electrical connector assembly defined in claim 1 wherein each of the first housing components has a cantilevered arm including both the terminal recess and a retainer opening, and wherein each of the second housing components has a retainer that cooperates with the retainer opening of the first electrical connector to retain the first and second electrical connectors together.

7. The electrical connector assembly defined in claim 1 wherein each of the first housing components has a cantilevered arm including the terminal recess and a polarizer recess provided in the terminal recess, and wherein each of the electrical terminals has a polarizer that cooperates with the polarizing recess.

8. The electrical connector assembly defined in claim 1 wherein:

each of the first housing components has a retainer opening;

each of the second housing components has a retainer;

the retainer opening of the first electrical connector cooperates with the retainer of the second electrical connector to retain the first and second electrical connectors together; and the retainer opening of the second electrical connector cooperates with the retainer of the first electrical connector to retain the first and second electrical connectors together.

9. The electrical connector assembly defined in claim 1 wherein:

the electrical terminal supported within the first electrical connector includes a first terminal arm and a second terminal arm;

the electrical terminal supported within the second electrical connector includes a first terminal arm and a second terminal arm;

the first terminal arm of the electrical terminal supported within the first electrical connector engages the second terminal arm of the electrical terminal supported within the second electrical connector; and the second terminal arm of the electrical terminal supported within the first electrical connector engages the first terminal arm of the electrical terminal supported within the second electrical connector.

10. The electrical connector assembly defined in claim 1 wherein:

the electrical terminal supported within the first electrical connector includes a first terminal arm, a second terminal arm, and a terminal plug;

the electrical terminal supported within the second electrical connector includes a first terminal arm, a second terminal arm, and a terminal plug;

the first terminal arm of the electrical terminal supported within the first electrical connector engages both the second terminal arm and the terminal plug of the electrical terminal supported within the second electrical connector; and the second terminal arm of the electrical terminal supported within the first electrical connector engages both the first terminal arm and the terminal plug of the electrical terminal supported within the second electrical connector.

11. The electrical connector assembly defined in claim 1 wherein:

the electrical terminal supported within the first electrical connector includes a first terminal arm and a second terminal arm;

the electrical terminal supported within the second electrical connector includes a first terminal arm and a second terminal arm;

the first terminal arm of the electrical terminal supported within the first electrical connector engages the second terminal arm of the electrical terminal supported within the second electrical connector; and the second terminal arm of the electrical terminal supported within the first electrical connector engages the first terminal arm of the electrical terminal supported within the second electrical connector.

12. The electrical connector assembly defined in claim 1 wherein:

the electrical terminal supported within the first electrical connector includes a first terminal arm, a second terminal arm, and a terminal plug;

the electrical terminal supported within the second electrical connector includes a first terminal arm, a second terminal arm, and a terminal plug;

the first terminal arm of the electrical terminal supported within the first electrical connector engages both the second terminal arm and the terminal plug of the electrical terminal supported within the second electrical connector; and the second terminal arm of the electrical terminal supported within the first electrical connector engages both the first terminal arm and the terminal plug of the electrical terminal supported within the second electrical connector.

* * * * *